United States Patent [19]

Cornet

[11] 4,011,797

[45] Mar. 15, 1977

[54] OIL-COOLED PISTON FOR A HEAT ENGINE

[75] Inventor: André Cornet, Levallois-Perret, France

[73] Assignee: DAMPERS Société Anonyme, Boulogne, France

[22] Filed: July 15, 1974

[21] Appl. No.: 488,228

[30] Foreign Application Priority Data

July 19, 1973 France ..... 73.26584

[52] U.S. Cl. ..... 92/186; 123/41.35; 123/193 P

[51] Int. Cl.[2] ..... F02F 3/20

[58] Field of Search ..... 123/41.35, 193 P; 92/186, 238

[56] References Cited

UNITED STATES PATENTS

| | | | |
|---|---|---|---|
| 2,048,002 | 7/1936 | Frelin | 92/186 X |
| 2,687,931 | 8/1954 | Flynn, Jr. | 123/41.35 |
| 2,759,461 | 8/1956 | Maybala et al. | 123/41.35 |
| 2,865,348 | 12/1958 | Kramer et al. | 123/41.35 |
| 3,349,672 | 10/1967 | Meier et al. | 123/41.35 X |
| 3,613,521 | 10/1971 | Itano | 123/41.35 X |
| 3,703,126 | 11/1972 | Haug | 123/41.35 X |

FOREIGN PATENTS OR APPLICATIONS

| | | | |
|---|---|---|---|
| 800,350 | 10/1950 | Germany | 123/41.35 |
| 489,103 | 9/1950 | Italy | 123/41.35 |
| 401,152 | 1/1945 | Italy | 123/41.35 |

*Primary Examiner*—Charles J. Myhre
*Assistant Examiner*—William C. Anderson
*Attorney, Agent, or Firm*—Hopgood, Calimafde, Kalil, Blaustein & Lieberman

[57] ABSTRACT

A piston for a heat engine has a chamber adjacent the piston head, for receiving cooling oil for cooling parts of the piston that in operation are subjected to elevated thermal stress. An oil inlet and an oil outlet provide for a suitable flow of oil into and out of the chamber, to ensure controlled cooling of the piston in particular of the piston head surface and the piston ring area. The chamber can be of annular shape so that the central part of the head surface remains uncooled.

The invention is particularly suitable for a composite-structure piston.

24 Claims, 4 Drawing Figures

OIL-COOLED PISTON FOR A HEAT ENGINE

BACKGROUND OF THE INVENTION

The present tendency of development as regards pistons for internal combustion engines, in particular those such as diesel engines which are subjected to an elevated thermal loading, is directed mainly to two basic criteria, namely the pursuit of increased levels of engine performance, and a reduction in weight. A major concern of manufacturers is thus to resolve the problems raised by increasing compression ratios and increasing engine outputs, as well as the possible addition of supercharging systems, but without increasing the weight of the engine.

The piston remains one of the components of the engine which is the most exposed to very severe heat stresses, combined with mechanical forces, which are a necessary result from such developments. This therefore raises difficult problems as regards the service life of the pistons, particularly in dealing with the high temperatures generated at the pistons, cooling the piston ring areas of the pistons, and achieving the optimum coefficient of strength at the most highly critical places of the piston.

The above problems tend to affect the performance of the piston. However the rising increases in engine output gives rise to another danger, in so far as the engine manufacture who wishes to increase the output of the engine is naturally led to reduce the stroke of the piston, which also generally has the advantage of reducing the space occupied by the engine, and also its weight. Using a conventional expression in the art, engines are tending to become "square" or even "oversquare," that is to say, the bore-stroke ratios adopted are coming closer and closer to and even exceeding unity. The piston inevitably suffers from the repercussions of such changes, in that the height of the piston above the small end connection and also the total height of the piston decrease. Under these conditions, the small end connection between the connecting rod and the piston is brought very close to the head or top face of the piston, where the temperatures are at their highest. The oscillating movement of the small end shaft therefore occurs in a very testing medium, which can involve serious dangers of phenomena such as rupture or seizing.

SUMMARY OF THE INVENTION

An object of the present invention is to provide improvements which can be applied to a piston of heat engines in general.

Another object is to provide a piston capable of overcoming the above-mentioned difficulties arising out of increasing engine outputs and thermal loadings, and also reductions in the bore-stroke ratio.

Yet another object of the invention is a piston which has an improved piston and small end lubricating system.

These and other objects are achieved according to the invention by a piston which has a chamber provided with an oil inlet and an oil outlet, the chamber confining an oil reservoir space immediately adjacent to a part at least of the front face of the piston and its lateral face where the piston carries one or more piston rings.

The function of this chamber is to contain an amount of oil which is constantly renewed during operation of the engine and which is agitated by the piston motion, thereby ensuring piston cooling by direct contact of oil with the adjacent faces of the piston.

The capacity of the chamber thus formed, which acts as an oil reservoir, must be sufficient for the needs of each particular case, in particular the magnitude of the heat loading to be removed. It should be noted in this respect that the capacity of the chamber, combined with the rate of renewal of the oil therein, must be sufficient to avoid calcination of the oil, or even boiling of the oil, which could create excessive pressure within the chamber and thereby impede the intake of fresh oil into the chamber. In the event of substantial boiling of the oil, the oil feed of the chamber and the renewal of oil in the chamber would occur irregularly, in stops and starts, and could cause calcination, which would be even more serious.

It should be noted in this connection that, although the system according to the present invention can be applied to pistons in general, the provision of a chamber having the desired capacity according to each particular case is generally viewed in a more favourable light for composite-structure pistons than for pistons of a unitary construction.

The oil chamber can be a cavity of cylindrical shape which is delimited by the front face of the piston, by a part of its piston ring-carrying side face, and by a face which is opposite to the front face in the axial direction of the piston. When the piston is arranged with its axis vertical or slightly inclined, the said opposite face will form the bottom of the oil reservoir chamber.

Advantageously the oil outlet of the chamber comprises one or more holes in the bottom of the reservoir, providing a passage for an equal number of oil jets or sprays directed towards the small end connection of the piston.

In another embodiment, the chamber is of annular shape so as to ensure direct-contact cooling only at the portion of the side wall of the piston at which the piston rings are disposed and an adjacent annular part of the head or front face of the piston. The advantages afforded by this arrangement, which amounts to preventing direct contact of the cooling oil with a central area of the front face of the piston, will be apparent hereinafter.

In accordance with another arrangement of the invention, the oil chamber has cavities or portions of increased depth which extend into support portions in the piston which are provided for carrying the small end shaft. As will be seen hereinafter, this arrangement facilitates lubrication of the small end shaft. In addition, it makes it possible to provide an additional oil reserve which, at least in some cases, may remain in the chamber when the engine is stopped, thus providing improved lubrication during the critical phase of starting the engine.

DESCRIPTION OF THE PREFERRED EMBODIMENTS

Figure 1:
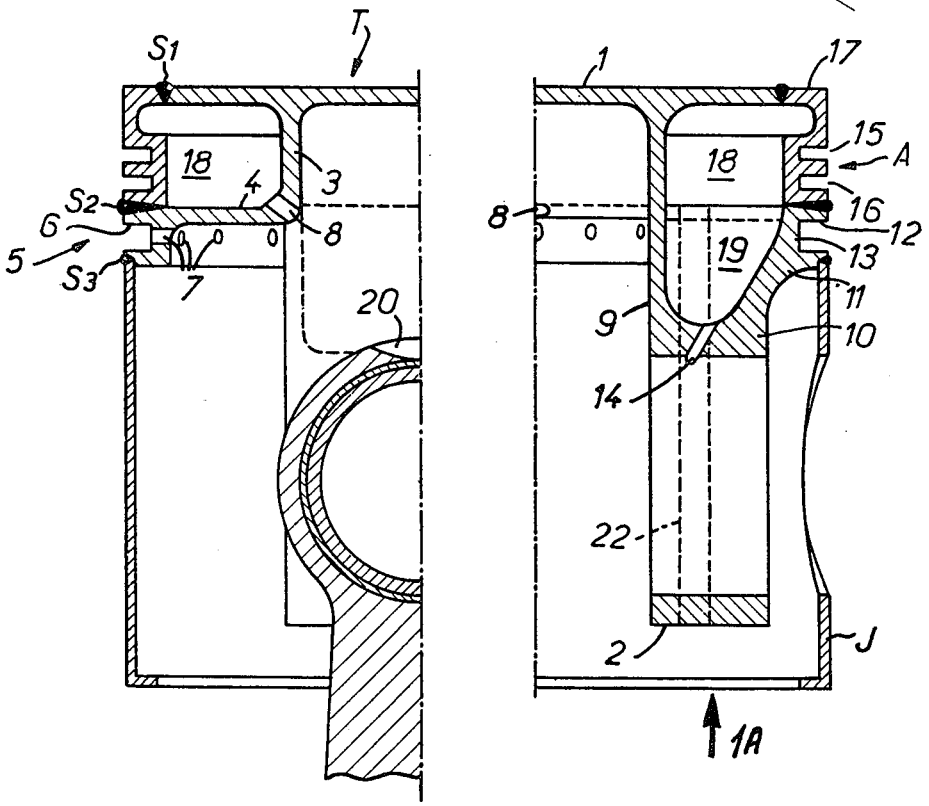
FIG. 1 shows two half views of a piston without a combustion chamber, which has an oil feed by oil sprays or jets and which can be used more particularly in vertical in-line engines or V-engines, the lefthand view being in axial cross-section in a plane perpendicular to the small end shaft or gudgeon pin of the piston, the righthand view being in axial cross-section in a plane perpendicular to the above-mentioned plane.

Referring firstly to FIG. 1 which shows a piston whose geometrical axis is disposed vertically, although this position is not to be considered as limiting, the pistion illustrated by way of example is of a composite structure comprising three parts which are produced separately and which are joined together after manufacture, namely a head part T, an annular part A for carrying piston rings (not shown), and a skirt part J.

The head part T in the embodiment illustrated is a component which is produced by casting and which comprises, formed in one piece, a flat front wall or head 1 and two bearing assemblies 2 for supporting the small end shaft, sometimes called the wrist pin or gudgeon pin.

Over two diametrally opposed angular sectors of which one is shown in the left-hand view in FIG. 1, the head part T comprises a respective vertically disposed rib 3 which projects downwardly from the downward or inside face of the wall 1. The ribs 3 are disposed at a distance from the axial centre line of the piston which is substantially less than the radius of the piston. At its lower end portion the vertical rib 3 is perpendicularly extended by a radially outwardly directed flange or horizontal rib 4 which is provided at its radially outward end with a peripheral edge portion 5 defining a U-shaped groove 6. The groove 6 is open radially outwardly, for receiving a scraper or oil-control piston ring (not shown). The groove 6 is provided with holes 7 at its base, that is to say in the base part of the U-shape.

Holes 8 which are angled at 45° approximately to the axis of the piston are provided in an angle wall portion connecting the two ribs 3 and 4.

Over the remaining two diametrally opposed angular sectors of which one is shown in the right-hand view in FIG. 1, the head part T has a vertically disposed rib 9 which projects from the downward or inside face of the wall 1 and which, like the ribs 3, is disposed at a distance from the axial centre line of the piston which is substantially less than the radius of the piston. The ribs 9 extend downwardly below the level of the ribs 4, and are each connected at their lower ends to a respective horizontal radially outwardly directed wall portion 10 which is in turn connected at its radially outer end to a generally upwardly directed wall portion 11 whose upper end part carries a peripherally extending edge portion 12 having a groove 13 which completes the circumferential extension of the above-mentioned grooves 6 in the edge portions 5.

The wall portions 10 each form the upper part of the respective bearing assembly 2 for the small end shaft and each has one or more holes 14 opening into the bearing aperture of the assembly 2.

Where the ribs 3 meet the ribs 9, they are rendered integral with each other over the whole height of the ribs, so that the ribs 3 and 9 together form a continuous annular wall portion of circular, rectangular or other suitable contour.

On its outside side face the annular part A has circumferential grooves 15 and 16 for receiving respective piston rings (not shown). The annular part A is positioned entirely above the above-described edge portions 5 and 12. A circumferential bead or ring of welding or brazing S1 connects the lower end of the annular part A to the edge portions 5 and 12. The upper peripheral edge of the annular part A has a radially inwardly directed rib 17 which is secured for example by a circumferential ring weld or brazing S2 to the outside peripheral edge of the head part T. The joins S1 and S2 can be made by any suitable method, for example arc welding, brazing, or with an electron beam.

Once the joins at S1, S2 have been completed, the two parts T and A co-operate to define an annular chamber 18 having two pockets or cavities 19 of increased depth, in line with the two bearing assemblies 2, the cavities being defined by the ribs 9, wall portions 10 and 11, edge portions 12 and end walls (not visible) closing the peripherally directed end openings of the cavities.

The chamber 18, together with the cavities 19, forms an oil-receiving reservoir of annular shape, the oil in the chamber 18 thereby providing direct-contact cooling only at the portion of the side wall of the piston at which the piston rings are disposed and an adjacent annular part of the head or front face of the piston. The advantages afforded by this arrangement, which amounts to preventing direct contact of the cooling oil with a central area of the front face of the piston, will be apparent hereinafter.

The skirt J is formed for example from a steel tube portion. Disposed below the grooves 6 and 13 for the scraper ring, the skirt J is connected to the head part T for example by circumferential welding or brazing S3.

Figure 1A:
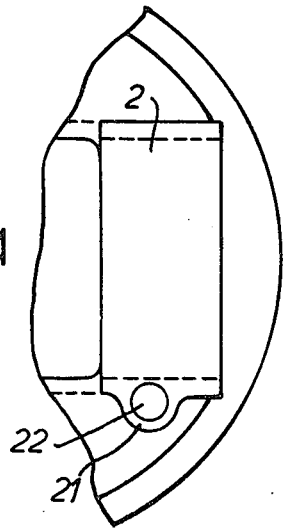
FIG. 1A shows a detail view of part of FIG. 1, in the direction indicated by arrow 1A.

At its top small end eye of the connecting rod (not referenced) has one or more cavities 20 which are disposed more or less in alignment with the inclined holes 8. On one of its vertical outside faces, one of the bearing assemblies 2 has a portion 21 of increased thickness in which is provided a vertical passage or hole 22 (FIG. 1A). The passage 22 is open at its lower end in line with and towards an oil projection jet (not shown) at the base of the engine cylinder in which in use the piston is placed. The hole 22 passes through the bearing assembly from the bottom to the top, and also through one of the two ribs 4, so as to open at its upper end into a relatively shallow zone of the chamber 18, that is, a part of the chamber adjacent the cavity 19.

FIG. 1 therefore diagrammatically shows a piston without a combustion chamber, comprising an arrangement for piston cooling by an oil projection jet secured to the base of the cylinder, the nozzle of which is aligned with respect to the oil feed passage 22. In each revolution of the engine crankshaft, the piston as it rises and falls will subject the oil to vigorous agitation in the chamber 18. By this action, the part of the head 1 of the piston which is most heavily loaded thermally, and the piston ring area at A, are cooled by the oil. On the other hand, the inside face of the central part of the head T, which has no communication with the annular chamber 18, will be subjected to a cooling action only by oil that may be projected or splashed from the connecting rod and small end assembly. In fact, in some cases the central part of the piston head should remain at a sufficiently high temperature, for the following reason:

In fuel injection engines, in particular direct injection engines, the jet of fuel which is sprayed by the injector nozzle is generally directed onto the central part of the head of the piston, as in order to achieve good combustion and carburation, the vaporised fuel spray should be projected onto a hot part in the combustion chamber. Consequently, it is advantageous as far as possible to limit the direct action of the cooling oil to the circumferential part of the head of the piston, and to the piston ring area of the piston.

However, in cases where the whole of the surface of the head of the piston is to be cooled, appropriate geometric modifications can be made to the piston, as described hereinafter.

As regards the position of the groove 6 and 13, it will be noted that it is part of the had part T and that it is positioned below the piston ring-carrier annular part A. As described above, the groove 6 and 13 is intended to receive the scraper ring (not shown), with its holes 7 for the oil return in the groove portions 6. The holes 7 are thus provided along the two sectors, in regions where there are no recesses or cavities 19. However the other two sectors 13 of the groove 6 and 13 do not have any return holes, as these would open into each of the two oil-receiving cavities 19 provided in the gudgeon pin bearing supports 2. On the other hand, in the two cavities 19, the holes 14 opening into the bearings of the assemblies 2 are intended to provide lubrication for the small end shaft or pin. As oil permanently remains in the two cavities 19 at least in vertical in-line engines or V-engines, this arrangement of the cavities 19 and the holes 14 can provide a substantial improvement as regards satisfactory lubrication of the two small end bearings of the piston. In the present forms of piston structure it is virtually impossible to lubricate this zone satisfactorily.

However, as regards lubrication, it is also possible to demonstrate other advantages concerning use of the cooling oil arrangement employing oil from the annular chamber 18. In fact, the arrangement of the oil outlet hole 8 makes it possible, by the holes being set at an appropriate orientation, abundantly to lubricate the small end coupling. Such small end lubrication can be easily provided, as it simply involves directing the overflow discharge from the chamber 18 on to the reciprocating small end bearing member. The recess or recesses 20 on the small end eye of the connecting rod can facilitate penetration of oil onto the small end shaft or pin. At the same time, and depending on the flow rate at which the oil arrives in the chamber 18, suitable calibration of the holes 8 will have the effect of maintaining in the annular chamber 18 the volume of oil necessary to regularise the temperature of the head of the piston and thereby also to cool the piston ring area at A. Also, using the two bearing support assemblies 2 for the small end shaft to provide additional oil reservoirs (cavities 19) for retaining oil provides the advantage that, as the cavities 19 are disposed below the discharge level of the holes 8, the cavities 19 will retain a certain amount of oil, even when the engine is stationary, and the retained oil may be very useful in providing lubricating for the gudgeon pin and small end bearings when the engine is started. In fact, when the engine rotates slowly and the engine oil pump has a low output, the projection jet for spraying oil into the passage 22 may not be sufficiently powerful to ensure satisfactory oil circulation. It is particularly at the start when the engine is cold and when the oil is still viscous that lubrication is imperfect, and often the first beginnings of a seizure of the gudgeon pin may occur during this period. Thus the two supplementary cavities 19 acting as an oil reserve are a form of safety device as regards maintaining lubrication since, as soon as the engine makes the first few revolutions, the oil retained in the cavities 19 will automatically provide lubrication in the piston.

Figure 2:
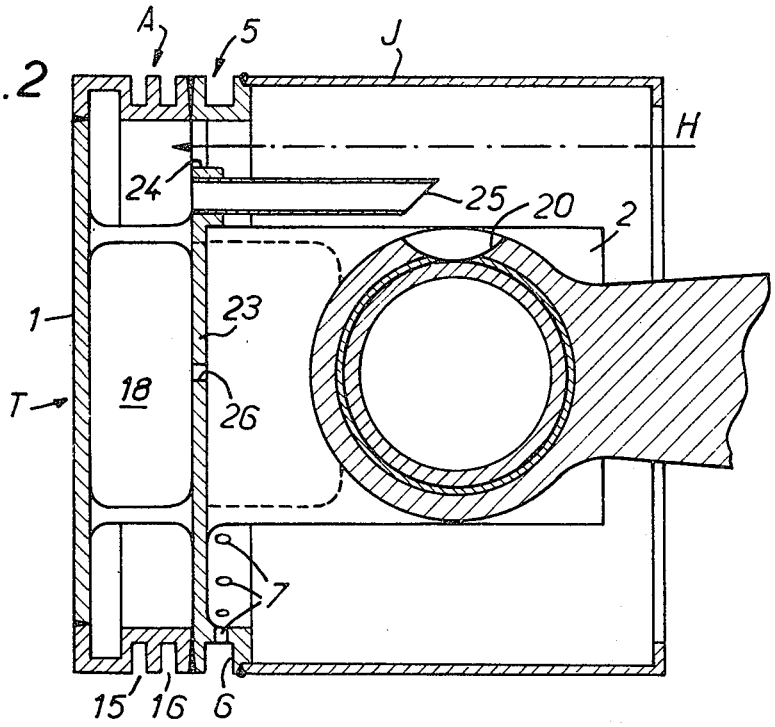
FIG. 2 shows a view in axial cross-section of a piston without a combustion chamber, which has an oil feed by oil jets and which can be used more particularly in horizontal engines.

Going on now to FIG. 2, the piston shown is particularly suitable for horizontally positioned engines, such as a flat twin; although the piston is shown in this position, it is not intended that this indicates a limitation as regards use of the piston in such a type of engine. The FIG. 2 piston includes components corresponding to some of the components shown in FIG. 1, which are therefore denoted by the same reference numerals. However, the geometry of the piston of FIG. 2 differs from that of the embodiment described above with reference to FIG. 1, from various points of view. Thus, the chamber 18 is no longer annular but is of round cross-section as viewed axially of the piston, so that it occupies the whole of the surface area defined at the head of the piston by the annular part A. The arrangement of horizontal ribs 4 of FIG. 1 is replaced by a partition or wall portion 23 which extends over the whole of the above-mentioned surface area at the piston head, except in line with the cavities 19 in the bearing assemblies 2. The ribs 3 no longer act as wall portions in the FIG. 2 piston but serve to stiffen the head part T, and have openings for the free circulation of oil within the piston head. The upper part (as viewed in FIG. 2) of the wall portion 23 has an aperture 24 disposed on a line H which aligns with an oil projection jet, as referred to above. A tube 25 which passes through the wall portion 23 is positioned slightly below the hole 24 and forms an oil outlet for oil in the adjacent part of chamber 18.

The wall portion 23 also has, on the axial centre line of the piston, another hole 26, the purpose of which will be described hereinafter.

In operation the oil inlet 24 receives the spray of oil from the projection jet at the base of the engine cylinder. The inlet can also be provided with an admission conduit or tube, similarly to the tube 25. In the horizontal position, the tube 25 channels oil from chamber 18 to its outlet end and thus lubricates the small end bearing assembly. As mentioned above, the hole 26 provides for a discharge of oil from chambers 18, and can be of a calibrated diameter dependent on the inlet flow rate of oil into the chamber 18, so as not to interfere with renewal of oil in the chamber, by injection through the aperture 24, in the case where it would be necessary to maintain a precise oil level in the chamber. The hole 26 thus serves as an outlet to prevent overfilling of the chamber 18. As described above with reference to FIG. 1, the two hollow bearing support assemblies 2 act as oil reservoirs adjacent the chamber 18. The provision at the bottom of such reservoirs of one or more holes opening into the small end bearing provides for suitable lubrication thereof.

Figure 3:
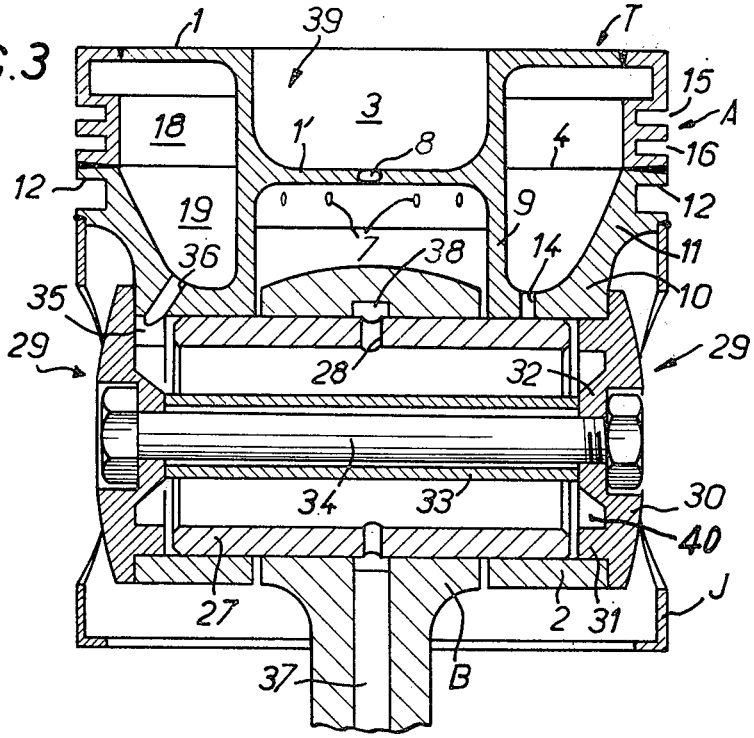
FIG. 3 shows a view in axial cross-section of a piston with a combustion chamber in its head, with a pressure oil circulation, whose preferred area of use is similar to that of the piston of FIG. 1.

The embodiment of FIG. 3 also contains components which, being identical or equivalent to some components already described above, are denoted by the same reference. This embodiment differs from the embodiment shown in FIG. 1 primarily by the provision of a combustion chamber in the head of the piston, and by the means for the cooling and lubricating oil feed.

A combustion chamber 39 is formed in the piston head by recessing a portion 1' of the front face 1, so that the portion 1' is positioned within the annular wall formed by the ribs 3 and 4.

The oil feed to the pistion is by way of a conduit or passage 37 in the connecting rod which opens into an annular groove 38 in the internal cylindrical face of the connecting rod small end eye B, that is to say, the face which acts as a bearing surface for the small end shaft or pin 27.

The shaft 27 is a hollow shaft which is formed by a sleeve or hollow cylindrical member whose wall has one or more apertures 28 arranged in line with the groove 38, in order to bring the groove 38 into communication with the interior of the sleeve or hollow member. The shaft 27 projects at each of its ends beyond the edge of the small end eye of the connecting rod, the projecting end portions being supported in the two bearings of assemblies 2 of the piston. However, the shaft 27 extends over only a part of the width of each bearing, and a sealing plug member or end cap 29 is received in the spaces remaining in each bearing at the ends of the shaft 27.

Each plug member 29 comprises a body portion in the form of a disc 30 which is applied in sealing contact to the outside face of the corresponding small end bearing. The disc 30 has an annular rib 31 which projects from its inward face (the leftward face in FIG. 3) and which engages into the space within the bearing, and a central annular projection or boss 32 which also projects from the inward face of the disc; the annular rib 31 and the central boss 32 thus define an annular groove 40.

A tube 33 is arranged as a spacer member between the two bosses 32, while a bolt 34 extends through the tube 33, and beyond the two ends of the tube 33 and through the two bosses 32. The head of the bolt and the tightening nut which are provided at the respective ends of the bolt are received in recesses provided in the outwardly directed faces of the discs 31 of the corresponding plug members 29.

The spacer tube 33 serves to carry compression forces caused by tightening the bolt 33, and its length is so adjusted as to permit these tightening forces to provide a sealing contact between the plug members 29 and the outside faces of the small end bearing assemblies 2, without the bearings being excessively stressed by tightening of the bolt. This arrangement provides for a simplification in assembly, by eliminating locking keeper rings or circlips which are usually required for holding a small end shaft or gudgeon pin in place in the piston.

One of the circular ribs 31 (that which is at the left-hand side in FIG. 3) has an aperture or notch 35 which is placed in line with a hole 36 in the wall portion 10 of one of the two chambers 19.

It will be seen therefore that, in the piston of FIG. 3, the piston head is cooled by the inlet of oil under pressure, coming from the crankshaft and the connecting rod. The oil under pressure arrives by way of the passage 37 in the connecting rod, circulates around the shaft 27 within the groove 38, then passes by way of the holes 28 into the interior of the shaft. After the internal volume of the shaft 27, including the two grooves 40, has been filled with oil, the oil passes into one of the resevoirs 19 by way of the opening or notch 35 provided in the left-hand plug 29, and passes through the hole 36 to flow into the chamber 19. The oil then passes from the cavity 19 into the annular chamber 18 and thence into the other cavity 19.

Under the oil pump pressure, the oil issues from the chamber 18 by way of one or more apertures 8 whose diameters are calibrated in dependence on the desired flow rate. The apertures 8 can possibly be so arranged that the outlet jet or spray therefrom is oriented onto the small end assembly in order to provide lubrication thereof. A hole 14 for lubricating the small end bearing can be provided at the bottom of the second cavity 19, at the right-hand side in FIG. 3.

However, in this FIG. 3 embodiment, which provides for cooling of the head of the piston by oil under pressure, the whole of the small end connecting assembly is already abundantly lubricated by the internal oil circulation in the piston so that it is possible to forego the discharge of oil from the apertures 8 onto the small end connecting assembly. It is thus possible to provide for the return of oil from the piston to the engine crank case by any other path considered suitable.

The above-described piston construction therefore provide:

- the possibility of including in the piston head a high-capacity oil reservoir capable of preventing excess oil vapour pressure, which could impede the admission of oil into the reservoir and could cause calcination thereof;
- the possibility of using the bearing support assemblies 2 as additional oil reservoir;
- the possibility of using the cooling oil as it issues from the reservoir for abundantly lubricating the small end assembly;
- the direct use of oil from the oil reservoir for lubricating the small end bearing assemblies.

Various modifications can be made without departing from the scope of the invention as defined by the appended claims. For example, instead of using a piston ring-carrier part A which is separate and which is subsequently assembled to the body of the piston by means of the two ring joins S1 and S2 it may be found preferably in some cases to cast the piston ring-carrier member with the body of the piston, in which case the annular chamber 18 can be closed by a cover member which is fitted into place and secured by two concentric ring joins such as by welding.

The above-described pistons can be used in various kinds of engines, for example vertical in-line engines, horizontally opposed engines, such as the engines referred to as flat twins by the man skilled in the art, or V-engines. The piston can be a piston without combustion chamber in its head, or a piston with a combustion chamber or a deflector on its head. The pistons can be associated with various systems of cooling, for example pressure circulation or pressure projected jet, without initial modification of the design or geometry of the piston. The pistons can provide an effective solution to difficulties which are inherent in the present development of increases in engine outputs, which make it necessary to use short pistons of reduced heights, and which result in the adoption of a piston structure in which the small end assembly is necessarily positioned in an area which is very close to the head of the piston, that is to say, at a position which is highly subjected to heat stresses and which it is thus necessary to abundantly lubricate and cool. It should also be noted that the two reservoir cavities 19 within the two bearing assemblies 2 form, for the bearing assemblies, a heat barrier for preventing the direct dissipation through them of the heat leadings resulting from combustion in the engine cylinder.

I claim:

1. An oil-cooled piston comprising a crown, a radial flange and means axially offsetting said flange beneath said crown, a ring section rigidly secured to said crown and flange for piston-ring support and defining therewith a circumferentially continuous annular oil chamber axially between said flange and crown and radially within the piston-ring support region of said ring section, a cylindrical skirt rigid with said flange and extending axially downward therefrom, two laterally spaced downward projections independent of said skirt and rigid with said crown and flange at opposed radial offsets from the piston axis and in radial clearance relation with said skirt, transversely aligned wrist-pin bearing means in said projections at a location axially beneath said flange and ring section, each of said projections having an upwardly open cavity extending from the region of said wrist-pin bearing means and upwardly through said flange and thus forming a local axially downwardly extending region of the oil chamber, and inlet and outlet flow-circulating means communicating with the chamber.

2. A piston according to claim 1 wherein the chamber is of a capacity, and the inlet and outlet flow-circulating means are calibrated, dependent on the thermal conditions of piston operation, for maintaining in the chamber an amount of oil which is subjected in pistion operation to an agitation movement, and for ensuring renewal of said oil.

3. A piston according to claim 1 wherein the inlet and outlet flow-circulating means are so proportioned to the capacity of the chamber that the chamber is capable of receiving an amount of oil sufficient for preventing the occurrence of excess oil pressure liable to impede the inlet flow of oil into the chamber.

4. A piston according to claim 1 wherein the chamber extends in circumferentially continuous radial overlap over at least some of the region of piston-ring support.

5. A piston according to claim 1 wherein the crown and flange walls of the chamber are generally in radial planes, whereby the chamber is of flat cylindrical shape.

6. A piston according to claim 5 wherein the chamber extends over the whole of the height of the portion of the ring section which has means for carrying piston rings.

7. A piston according to claim 1 wherein the oil outlet of the chamber is spaced from the surface thereof which in use of the piston is the lowest surface thereof, thereby to provide for the maintenance in the chamber of an amount of oil when the piston is stationary.

8. A piston according to claim 1 wherein the chamber has an oil outlet which is operative to discharge oil into the region between said projections, for oil spraying of the wrist-pin connected end of an assembled connecting rod.

9. A piston according to claim 1 wherein the chamber has one or more oil passages communicating with the respective bearing means.

10. A piston according to claim 1 wherein the chamber has a calibrated outlet for preventing overfilling of the chamber.

11. A piston according to claim 1 wherein said crown is a casting having a groove for a lower scraper piston ring.

12. A piston according to claim 1 wherein the oil inlet of the chamber comprises an aperture so positioned that when the piston is in an engine cylinder a jet at the base of the cylinder sends oils into the aperture.

13. A piston according to claim 1 wherein the wrist-pin bearing means includes an oil flow conduit for feeding oil into the chamber from a conduit in a connecting rod connected to the piston.

14. A piston according to claim 1 in which a wrist pin in the form of a sleeve is received in both bearing means and extends short of the radially outer end of the bores, a sealing plug member at each end of the shaft and bearing against the respective outside faces of said two projections adjacent said bearing means, thereby to define a space at each shaft end, such space at at least one end being in communication with one of said passages to the chamber, said sleeve having at least one hole in the central region of connecting-rod connection thereto, whereby oil fed to the wrist pin by way of a conduit in an assembled connecting rod may flow into and through the interior of said sleeve and an inlet passage into the chamber.

15. A piston according to claim 14 wherein one of said sealing plug members has a local recess cooperating to define the communication between the adjacent end space and the inlet passage.

16. A piston according to claim 15 wherein said cavities are diametrically opposed and are respectively disposed in vertical alignment with a said plug member, the inlet passage being in the bottom of one of said cavities.

17. A piston according to claim 14 and including a spacer tube member extending between the two plug members and in radial clearance with said sleeve, and a bolt member extending through the tube member and operable to hold said plug members in position.

18. A piston according to claim 1, wherein each cavity extends radially outwardly beyond the compass of its associated bearing means.

19. A piston according to claim 1, wherein each cavity is defined in a piston-axial cross-section by a profile flaring out to the crown.

20. A piston according to claim 1, in which said skirt is a third part, peripherally secured at its upper end to said crown.

21. A piston according to claim 1, in which said crown is a casting with said projections integrally formed therein.

22. An oil-cooled cylindrical piston, comprising a crown part, a ring part, and a skirt part; said crown part comprising a head-end closure wall, a relatively short axially downward cylindrical wall of substantially less than the outer diameter of the piston and integrally connected to said closure wall, said crown part further including a radially outward circumferentially continuous flange integrally connected to the lower end of said cylindrical wall, the outer diameter of said flange being the outer diameter of the piston, and two like laterally spaced axial projections extending downwardly from and integrally connected to said flange and cylindrical wall, said projections being at opposed radial offsets from the piston axis and having a maximum radial extent which is less than that of the piston, transversely aligned wrist-pin bearing means in said projections at a location axially offset from said flange, and each of said projections having a cavity formation which extends to the region of said bearing means and is upwardly open through said flange and external to said cylindrical wall; said ring part having an outer diameter matching that of the piston and an inner diameter substantially exceeding that of said cylindrical wall, said ring part having piston-ring retaining grooves in its outer wall and being peripherally continuously secured to said flange and to said closure wall to define an annular oil-cooling chamber with local extension of the chamber within said projections in the direction of said bearing means; said skirt part being secured to said flange and extending axially downward beyond and in radial clearance with said projections, and said crown part having inlet and outlet flow-circulating passage means communicating between the chamber and the space within said skirt part.

23. A piston according to claim 22, wherein the outer limit of said flange has a cylindrical surface having a piston-ring groove therein.

24. A cylindrical piston comprising an assembly of three separate component parts, namely, a head part of a given diameter, an annular ring part, and a cylindrical skirt part; said head part comprising a crown portion, a radial-flange portion, an inner peripherally continuous wall portion substantially inward of the piston diameter and integrally connecting said crown and flange portions in axially spaced relation, and two laterally spaced downward projections depending from said flange portion and inner-wall portion at opposed radial offsets from the piston axis and of maximum radial extent to clear the bore of said cylindrical skirt part, transversely aligned wrist-pin bearing means in said projections at a location axially offset from said flange portion, each of said downward projections flaring outwardly at juncture with said flange portion and having an upwardly and outwardly flaring cavity which extends through said flange portion; said ring part and said head part being rigidly secured to each other by two circular welds and cooperatively defining with said flaring cavities a circumferentially continuous oil chamber which extends circumferentially around said inner wall portion and which also extends locally downwardly to the region of said wrist-pin bearing means, said skirt part being rigidly secured to said flange portion and extending in axially overlapped and radially spaced relation to said downward projections, and inlet and outlet flow-circulating means communicating with said chamber.

* * * * *